US006544053B2

(12) United States Patent
Hahn et al.

(10) Patent No.: US 6,544,053 B2
(45) Date of Patent: Apr. 8, 2003

(54) PLUG CONNECTOR ARRANGEMENT

(75) Inventors: Joachim Hahn, Schmitten (DE); Carlo L'Abbate, Ludwigshafen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 09/950,947

(22) Filed: Sep. 13, 2001

(65) Prior Publication Data

US 2002/0048978 A1 Apr. 25, 2002

(30) Foreign Application Priority Data

Sep. 18, 2000 (DE) ..... 100 46 014

(51) Int. Cl.[7] ..... H01R 13/62
(52) U.S. Cl. ..... 439/157; 439/372
(58) Field of Search ..... 439/157, 153, 439/372, 310

(56) References Cited

U.S. PATENT DOCUMENTS 5,205,752 A * 4/1993 Taguchi et al. ..... 439/157
5,829,994 A * 11/1998 Oda et al. ..... 439/157
5,888,081 A * 3/1999 Konoya et al. ..... 439/157
6,019,618 A * 2/2000 Nakata ..... 439/157
6,030,250 A 2/2000 Sawayanagi

FOREIGN PATENT DOCUMENTS

| | | | |
|---|---|---|---|
| DE | 87 14 016 | 1/1988 | ..... H01R/13/629 |
| DE | 0 556 762 A1 | 8/1993 | ..... H01R/13/629 |
| EP | 0646 993 A2 | 4/1995 | |
| EP | 0977 324 A2 | 2/2000 | |

OTHER PUBLICATIONS

European Search Report, dated Dec. 5, 2002.

* cited by examiner

*Primary Examiner*—P. Austin Bradley
*Assistant Examiner*—Ross Gushi

(57) ABSTRACT

The invention relates to a plug connector arrangement with a two-part mating halves (1, 29), in which a first mating half (1) can be joined to a second mating half (29) via a plug-in control (7). The plug-in control (7) has a lever arm (2) pivotally mounted on a mating half (1) that controls a gearing region (9, 36, 37), forcibly actuating the mating halves (1, 29). The lever arm (2) is provided on one side on the mating half (1) and in addition to its pivot movement (8) is mounted via a pivot support (10) on the mating half (1) to ensure that the mating halves and the electrical connections are securely joined, despite simple construction, whereby the invention may be used in as many different ways as possible.

17 Claims, 6 Drawing Sheets

Fig. 9
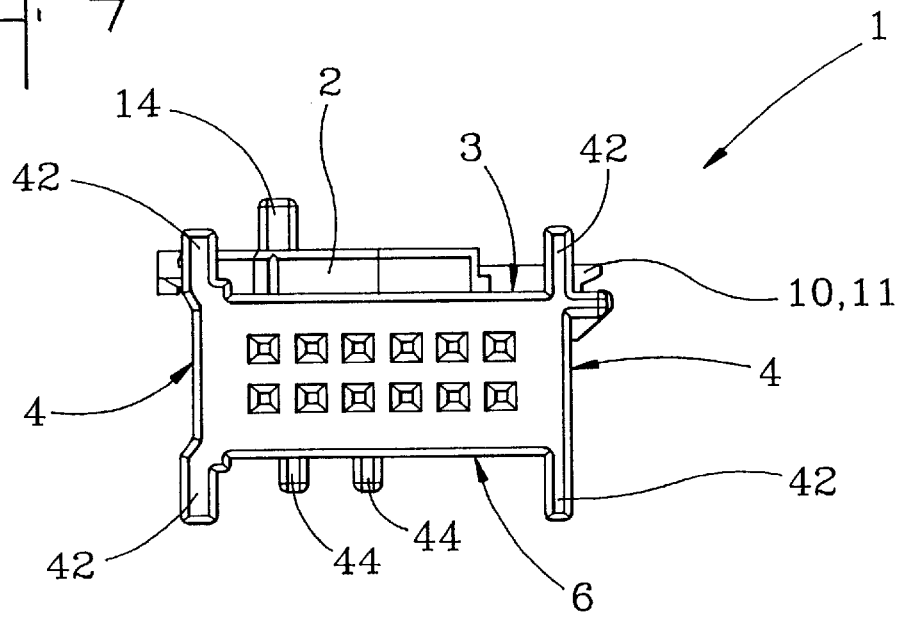
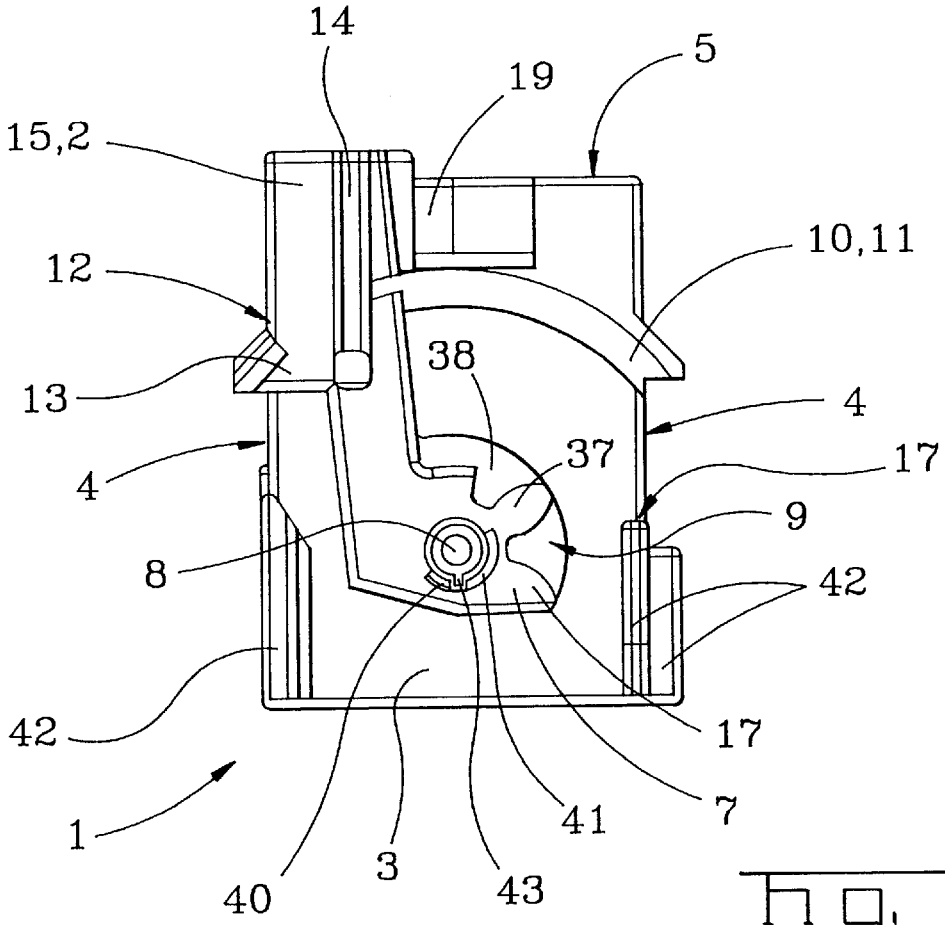
Fig. 10

PLUG CONNECTOR ARRANGEMENT

BACKGROUND OF THE INVENTION

The invention relates to a plug connector arrangement, and more specifically, to a plug connector arrangement with a two-part housing in which a first mating half can be joined to a second mating half via a plug in control.

DESCRIPTION OF THE PRIOR ART

In a plug connector arrangement of the type known from EP 556 762 A1, a toothed rack portion is provided on the second mating half and a lever arm is provided on the first mating half. The lever arm has a pinion portion in the vicinity of its fulcrum. In an open position, the lever projects substantially upwards and the pinion portion can engage in the toothed rack portion by slight pivoting of the lever in the direction of the closed position. As a result of further pivoting of the lever, the second mating half is pulled towards the first mating half so that contact pins at the base of the second mating half are inserted into receptacle contacts of the first mating half to form an electrical connection.

The lever extends on two opposing external sides of the first mating half so that the mating halves are guided towards one another without being tilted and in a straight line,. Toothed rack portions are provided on the second mating half on respective opposing sides accordingly. Both lateral lever portions are connected to one another by a lever bridge extending on the outside via the mating halves. The cable extends laterally perpendicular to the mating direction of the two mating halves. A similar generic plug connector arrangement is described in DE 8714016 U1.

A problem exists in that while the lever mechanism, overcomes the mating forces, additional installation space is required for the lever mechanism.

SUMMARY OF THE INVENTION

An object of the present invention is to provide a plug connector arrangement of the type described such that the mating halves and the electrical connections are securely joined, despite simple construction, whereby the invention may be used in as many different ways as possible.

This and other objects are achieved with a generic plug connector arrangement where the lever arm is provided on one side on the mating half, and in addition to its pivot bearing, is mounted via a pivot support on the mating half. Therefore, the exit of the line or cable from the mating half supporting the lever can be selected relatively freely at the end faces of the mating half. They can branch off from the end faces, which are located in the pivot sector of the lever. For example, a line exit can extend into the joining direction of the two mating halves. As a result, wider cables with lines can be used, such as flat foil conductor connections.

The mating halves may also be joined to the lever arm provided on a side of the mating half. In this case, the pivot support transmits actuating forces and transverse forces between the two mating halves and the mating halves are moved towards one another in a relatively straight, untilted manner. The pivot supports can extend over the entire pivot range of the lever arm, ensuring effective support of the actuating and/or joining forces in each desired angular position of the lever arm.

BRIEF DESCRIPTION OF THE DRAWINGS

Embodiments of the invention will be described hereinafter and shown in the drawings, in which:

FIG. 9 shows a bottom view of the first mating half of FIG. 8 with the attached lever arm of FIGS. 6 and 7, and FIG. 10 shows a cross-sectional view of the first mating half of FIG. 8 with the lever arm of FIGS. 6 and 7 tilted by 90° with respect to FIG. 9.

DETAILED DESCRIPTION OF THE PREFERRED EMBODIMENT

Figure 1:
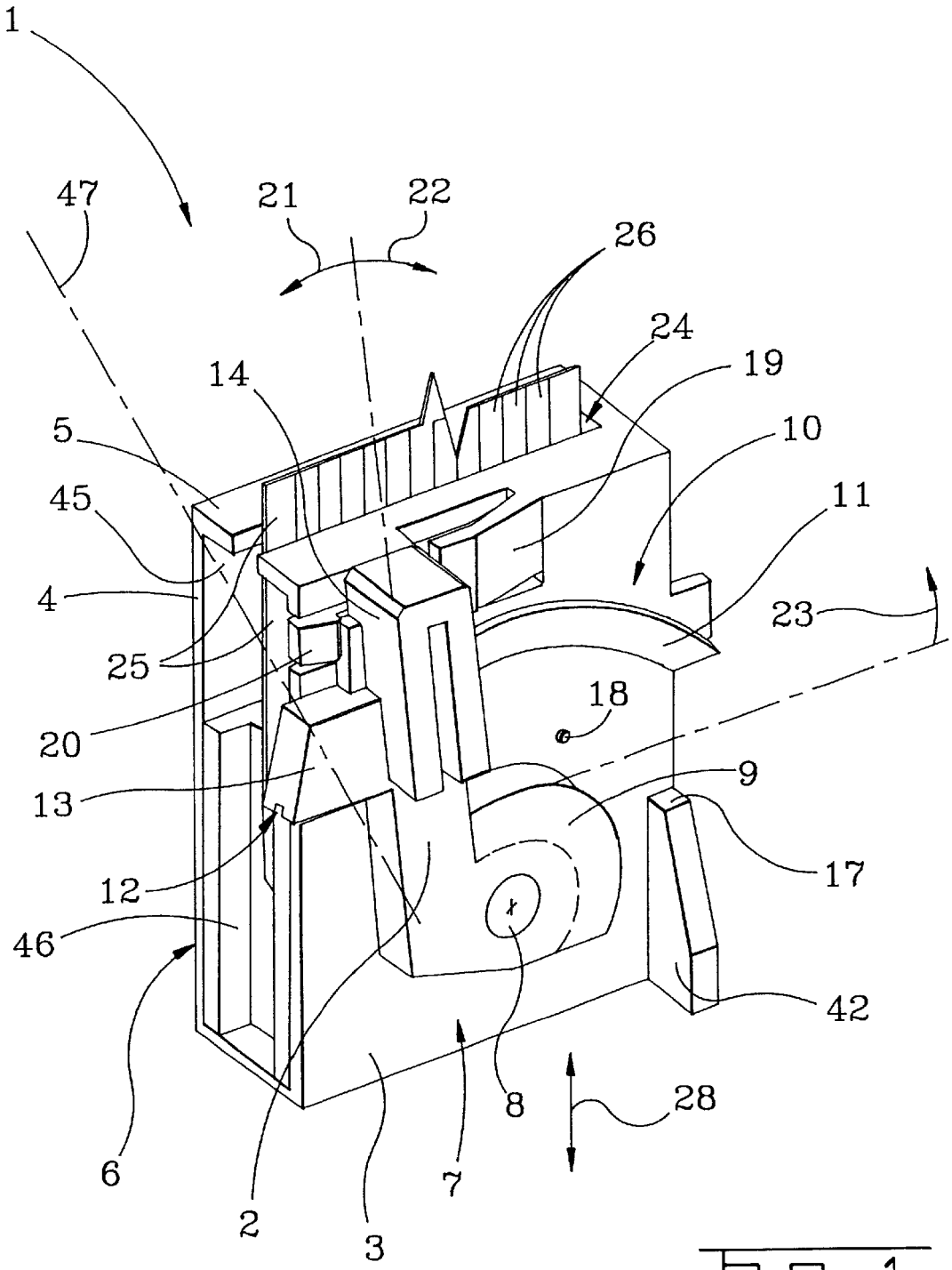
FIG. 1 shows a perspective view of a first mating half wherein a lever arm of a plug connector arrangement is in a closed position in accordance with a first embodiment.
Figure 2:
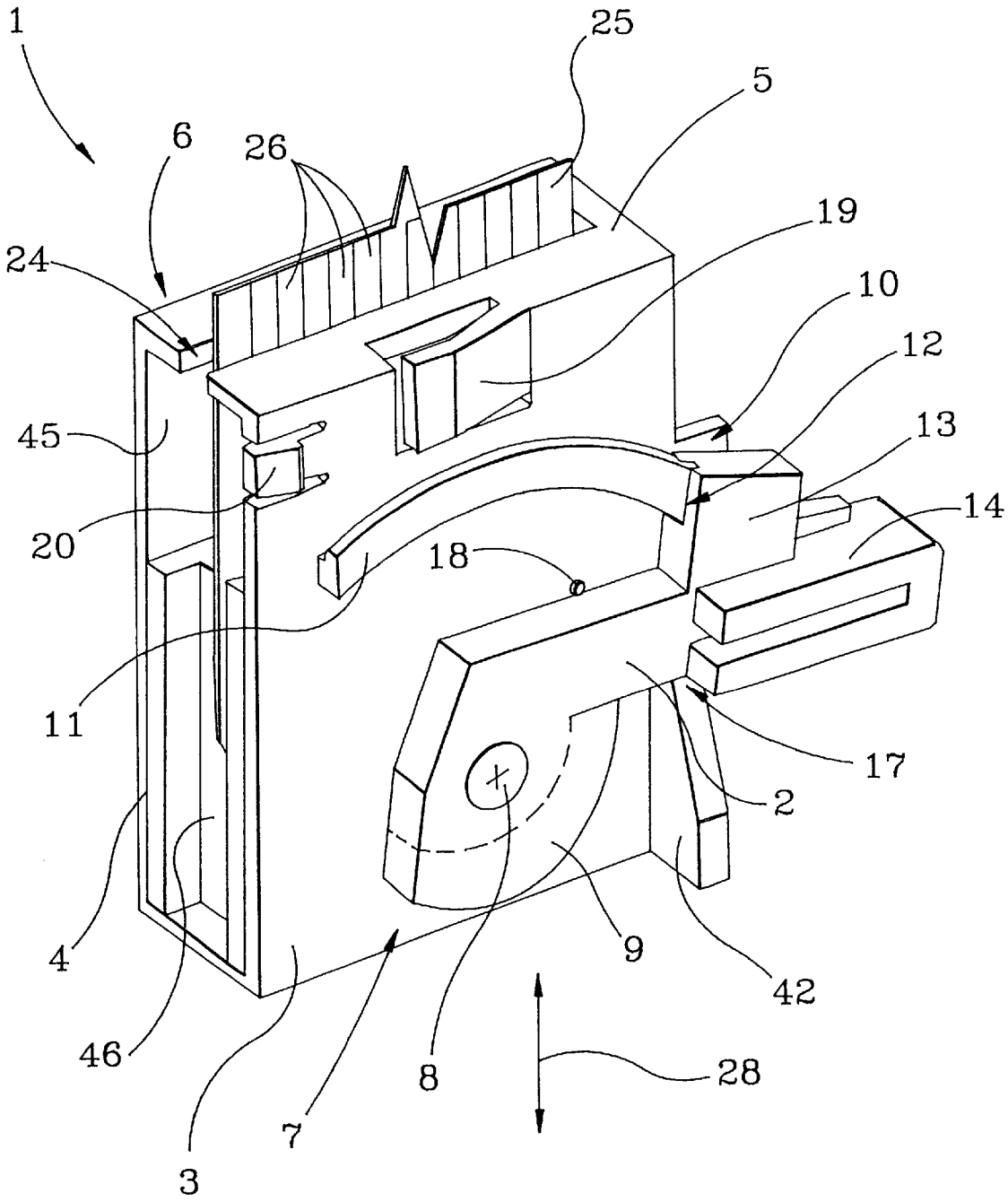
FIG. 2 shows a perspective view of the first mating half wherein the lever arm of FIG. 1 is in an open position.

FIGS. 1 and 2 show a first mating half with the lever arm attached thereto. The first mating half 1 has six sides. The lever arm 2 is mounted on one of the large sides, namely the lever side 3. The large parallel side 6 opposing the large side 3 does not have a lever. The narrow longitudinal sides 4 or the narrow end faces 5 are not touched by the lever arm 2.

The lever arm 2 is part of a plug-in control 7 and is rotatably mounted via an axle 8 on the first mating half 1. A gearing portion 9 on the lever arm, which covers a specific sector and is shown schematically in FIGS. 1 and 2 by dashed lines separate from the rest of the lever arm 2, partially extends about the axis 8. The gearing portion 9 can, for example, have teeth of a toothed wheel pinion as described in more detail hereinafter.

The axle 8 forms a pivot bearing from which the lever arm 2 extends substantially radially outwards. A pivot support 10 is provided near the axle 8. The radial portion of the lever arm 2 is mounted on the mating half 1 by the pivot support 10.

The pivot support 10 is designed as a curved guide rail 11 which is formed on the first mating half 1 and extends substantially concentrically about the axis 8, almost over the pivot range of the lever arm 2 about the axis 8.

The guide rail 11 is received in a guide groove 12 of the lever arm 2. The guide rail 11 has a substantially L-shaped profile in cross-section in which the guide groove 12 engages with interlocking fit from behind, viewed in the direction parallel to the extension of the shaft 8.

A guide portion 13, which extends from the radial direction laterally in the pivot direction, is formed on the lever arm 2 laterally offset to the radial direction of extension of the lever arm 2. The guide groove 12 is formed partially in the region of the guide portion 13. Guide groove 12 and guide portion 13 are provided substantially in a grip region for a user of the lever, viewed in the radial direction of extension of the lever arm. The grip region 14 is formed in the present case as an enlarged actuation region.

FIG. 1 shows the lever arm 2 in a closed position, while FIG. 2 shows it in an open position. In the open position the lever arm is attached to a wall ledge 17 which delimits the pivot range. In the direction of the closed position, the lever arm 2 is attached to a latching knob 18 which can be overcome by moderate force expenditure in the direction of the closed position.

In the open position, the guide portion is still engaged with the guide rail 11, while the remaining radial region of the lever arm 2 is arranged outside of the extension of the guide rail 11. The closed position is restricted from the open position by a latch 19 and from the opposing side by a catch 20. The grip region 14 with the guide portion 13 of the lever comes to rest with interlocking fit between latch 19 and catch 20.

The latch 19 is designed as a latching clip, which extends substantially tangentially to the pivot direction and is formed integrally with the mating half 1. It may easily be pushed in merely by pivoting from the open position to the closed position, so it can be overcome and springs back again in the closed position, so it rests with its end face on the lever arm 2 and prevents pivoting back. In this position it has to be pushed in manually toward the interior of the housing in order to pivot back the lever arm 2.

The catch 20 is provided as a spring clip 20 formed as one piece with the mating half 1 and externally delimits the pivot range of open position and closed position. In the position shown in FIG. 1, the catch 20 can be pushed manually towards the interior of the housing, so the lever arm 2 can also be pivoted to the left in the direction of the arrow 21. From there it is in an assembly position 47 in which it can be detached from the mating half 1. The dot-dash line 47 indicates the assembly position.

If the lever arm 2 is pivoted to the left in the direction of the arrow 21, then it is disengaged from the guide rail 11. From this position it can overcome the catch 20 merely by pivoting in the direction of the arrow 22 and can be rotated in the pivot range.

In contrast, the arrows 22 and 23 mark the pivot range. The adjacent dashed lines schematically show the alignment of the lever in the open and closed direction.

A recess 24, through which a contact foil portion 25 with a plurality of lines 26 extends outwards from the mating half 5, is provided substantially in the sector of the pivot range on the narrow end face 5 of the first mating half 1. Each of the lines 26 is conductively connected in the interior of the mating half 1 to a lead sleeve and secured thereto.

One of the narrow longitudinal sides 4 of the first mating half 1 has a large lead-in aperture 45, which is adjacent to the recess 24. The contact foil portion 25 can be inserted into the lead-in aperture 45 and connected to line sleeves 27 in the mating half 1. The contact foil portion 25 can optionally be attached to a foil holder 46, which can then be introduced together with the foil portion 25 into the lead-in aperture 45 and the mating half 1. The foil holder can also have lead sleeves 27.

The double arrow 28 marks the direction of movement along which the first mating half 1 can be moved relative to a second mating half 29 to produce an electrical contact between the lines of the respective mating halves by actuating the gearing region 9, or to break such a contact again. Consequently, a translatory displacement movement of the mating halves relative to one another is produced by rotation of the lever arm 2.

Figure 3:
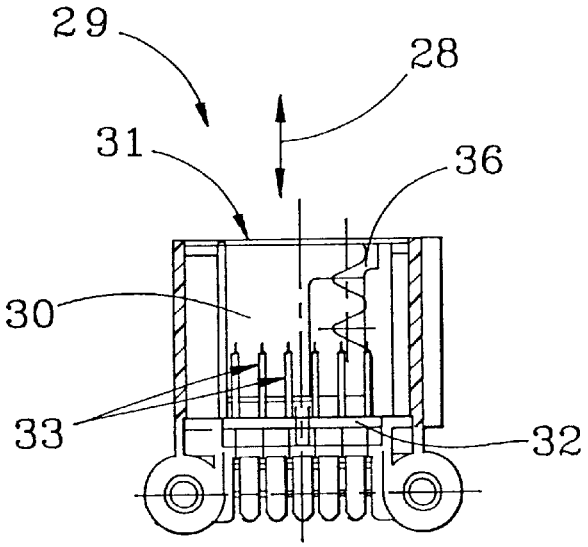
FIG. 3 shows a partial longitudinal section through a second mating half for a pluggable connection according to the invention along the line III—III in FIG. 5.
Figure 4:
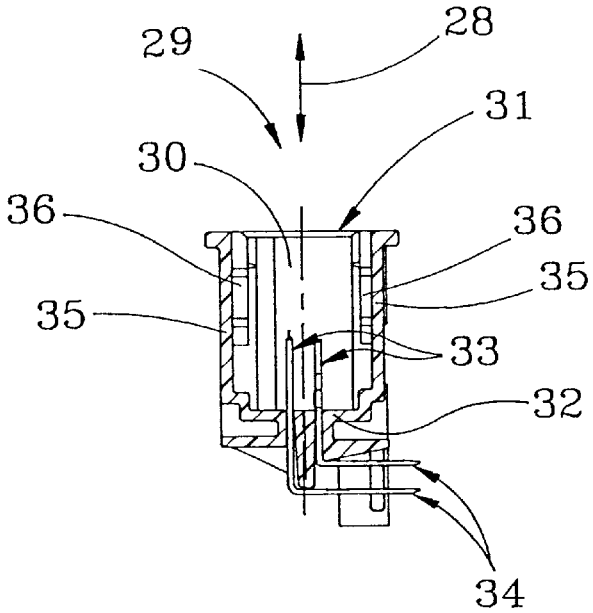
FIG. 4 shows a longitudinal section through a second mating half for a pluggable connection according to the invention along the line IV—IV in FIG. 5.
Figure 5:
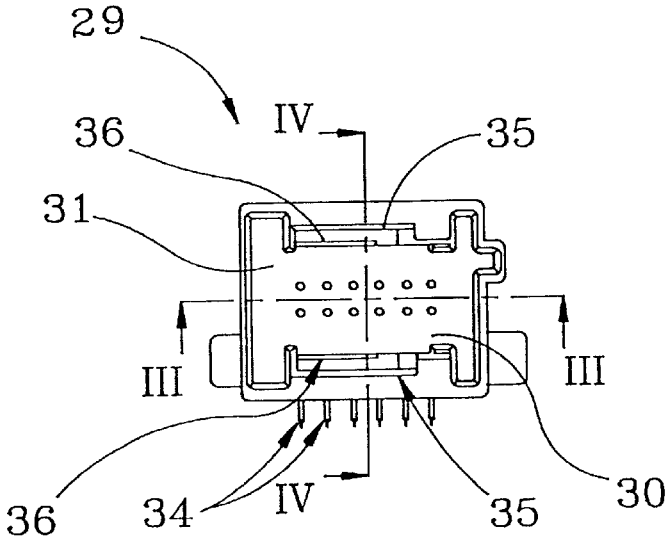
FIG. 5 shows a top view of the second mating half.

FIGS. 3 to 5 show a second mating half 29 which together with the embodiments of the first mating half 1, with lever arm shown here, form the pluggable connection arrangement according to the invention. The second mating half 29 has a receiving chamber 30 into which the first mating half 1 can be inserted in a translatory manner along the arrow 28 through an aperture 31.

Six pin contacts 33 arranged parallel to one another in two rows are provided in the base region 32. The pin contacts 33 project into the interior of the receiving chamber 30 parallel to the insertion direction 28. Each pin contact 33 is connected to a continuing printed circuit board contact 34. The arrangement of the pin contacts 33 corresponds to the arrangement of the line sleeves 27 of the first mating half 1.

The cross-section of the receiving chamber 30 with the aperture 31 substantially corresponds to the contour of the first mating half 1 with attached lever arm 2. A toothed rack portion 36 is formed on two opposing walls 35 in the interior of the receiving chamber 30, which portion 36 extends parallel to the insertion direction 28. The toothed rack portion 36 is a component of the gearing region and can be brought into engagement with the gearing portion 9 of the first mating half 1.

Instead of the two illustrated toothed rack portions 36 on two walls 35, which are provided for two separate levers on one side, just one toothed rack portion 36 can also be provided which cooperates with the gearing portion 9 of the lever arm 2.

Figures 6, 7:
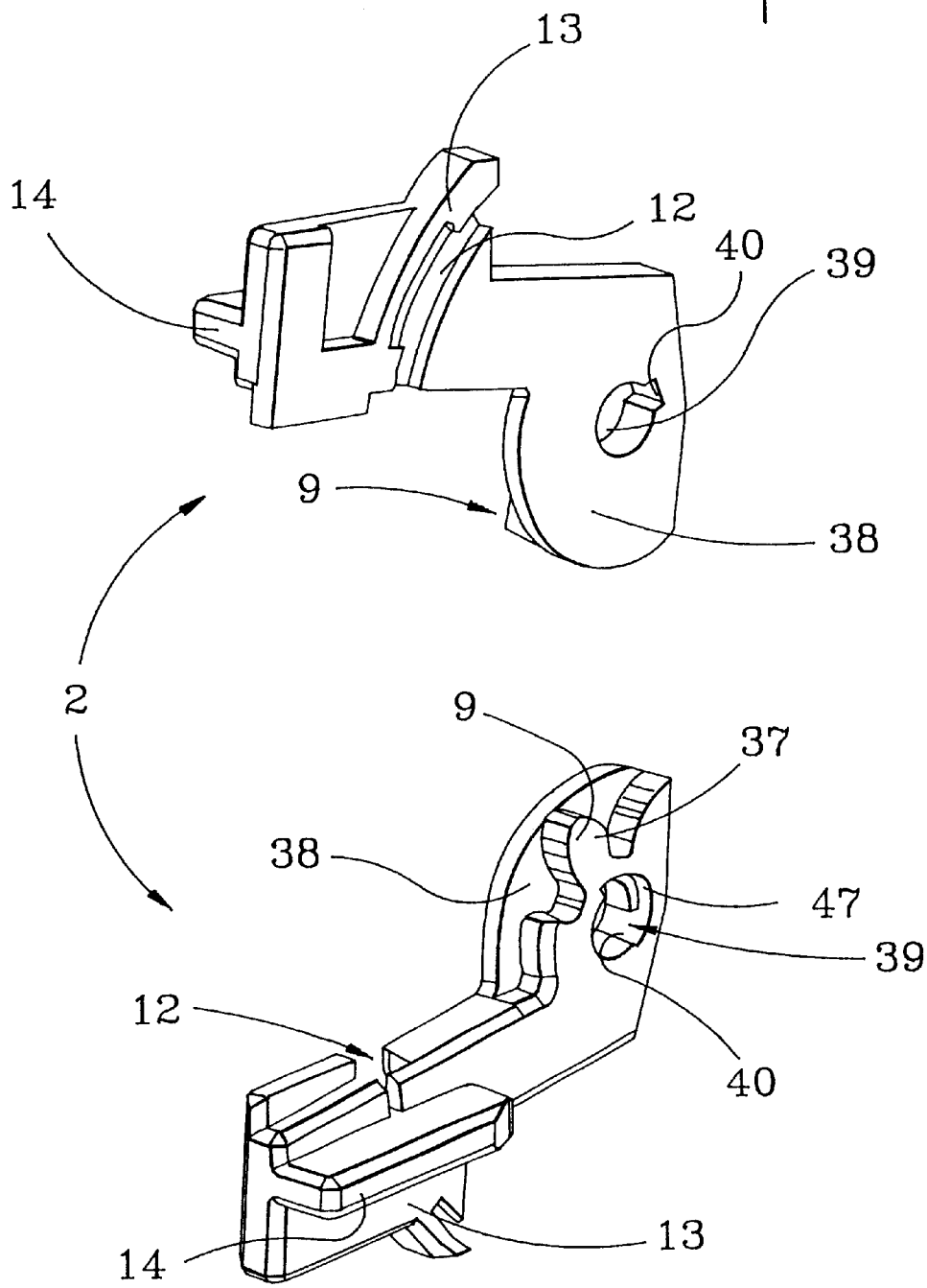
FIG. 6 shows a perspective view of a lever arm according to a second embodiment of the invention.
FIG. 7 shows a perspective view of the lever arm of FIG. 6, shown tilted by 180° with respect to FIG. 6.

FIGS. 6 and 7 show a lever arm for a second embodiment of the invention. Identical reference numerals denote identical or similar parts to the first embodiment, so reference is made in this regard to the preceding embodiment if no explanations to the contrary are given hereinafter.

The gearing portion 9 has two pinion teeth 37 which are formed on a base plate 38 of the lever arm 2.

A hole 39 is provided centrally which has an approximately keyhole-type cross-section. At the side of the pinion teeth 37 of the lever arm 2 a finger-like region of the hole 39 extends radially into a sector-like engaging recess 40 behind an overleaf round ledge 41 of the hole 39.

Figure 8:
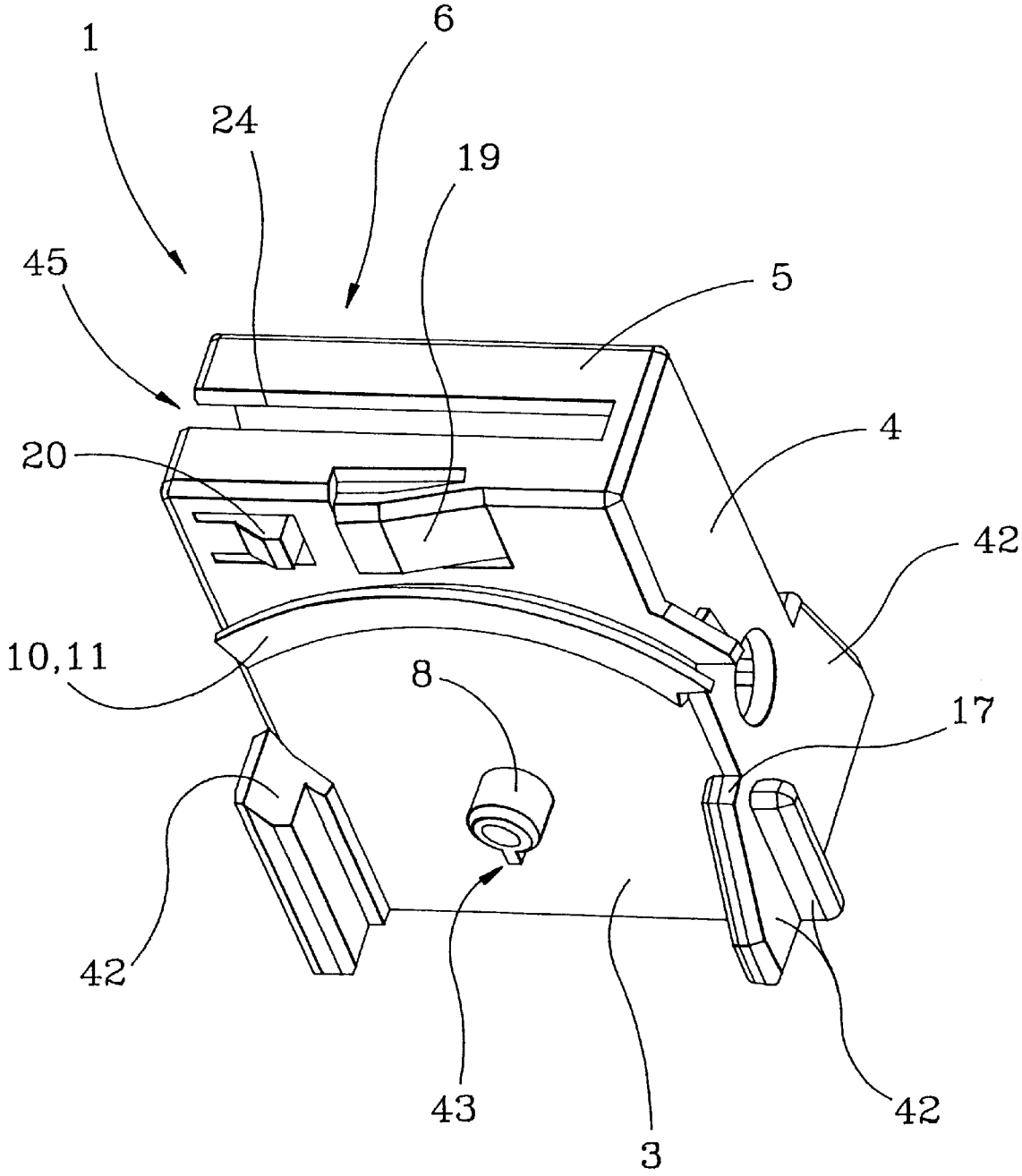
FIG. 8 shows a perspective view of a first mating half shown without the lever arm in accordance with the second embodiment according to the invention.

FIG. 8 shows a first mating half 1 of the second embodiment, which can be used together with the lever arm 2 shown in FIGS. 6 and 7. Reference is similarly made to the configurations of the first embodiment with respect to identical reference numerals.

Wall struts 42 projecting substantially perpendicularly from the housing sides are provided in the bottom region of the mating half 1 on the outside. The wall struts 42 substantially correspond to the internal contour of the receiving chamber 30.

On the side 3 to which the lever arm is fastened, the axle 8, which has a radially projecting nose 43, extends perpendicularly outwards.

FIGS. 9 and 10 show the lever arm 2 and the mating half 1 of FIGS. 6 to 8 in the assembled state.

The arrangement of line sleeves 27 on the bottom of the mating half 1 can be seen in FIG. 9. The arrangement corresponds to the arrangements of the pin contacts 33 of the second mating half 29.

Two support walls 44 are formed on the outside on the side 6 remote from the side 3 supporting the lever arm 2. The support walls 44 extend parallel to the movement direction 28 of the two mating halves 1 and 29. When the mating halves 1 and 29 are joined together, they rest on the end face of the wall of the second mating half 29. They are arranged on the side 6 in such a way that when the first mating half 1 is inserted into the second mating half 29 they slide freely past the second toothed rack portion 36.

In the closed position of the lever 2 shown in FIG. 10 it can be seen that the nose 34 engages behind the round ledge 41, so this region of the lever arm is fastened with interlocking fit to the first housing part 1 in the pivot range between open and closed position. If, on the other hand, the lever is rotated toward the assembly position shown, then the nose 43 arrives in the region of the finger-like engaging recess 40. This type of fastening corresponds to a bayonet-type closure.

The mode of operation of the embodiment according to the invention shown in the drawings will be described in more detail hereinafter.

The lever is pushed axially onto the axle 8 in the angular position of the assembly position. In the process, the nose 43 penetrates through the engaging recess 40. The catch 20 is overcome by pivoting the lever in the direction of the closed position. In the process, the nose 43 engages behind the round ledge 41 and the guide groove 12 is pushed onto the guide rail 11 with interlocking fit. By pushing down the catch 9, the lever arm 2 can be pivoted into the open position.

The first mating half 1 with the lever arm 2 is pushed with interlocking fit with its bottom in the insertion direction 28 through the aperture 31 into the receiving chamber 30 until the first pinion tooth 37 engages with the toothed rack portion 36. From this position, the lever is slowly moved from the open position into the closed position. Owing to the rotational movement of the lever, the two mating halves 1 and 29 are forcibly moved towards one another in a translatory manner with the aid of the gearing region 9 and 36. The pin contact 33 is slowly and accurately guided into the line sleeves 27, so that an electrical contact is produced.

The actuating forces and operating forces are supported via the pivot supports 10 during pivoting of the lever. An additional auxiliary position is provided by the support walls 44 by which forces of the first mating half 1 are supported on the second housing part. Despite the one-sided arrangement of the lever with the gearing in the region 9, straight introduction of the housing parts is possible.

The contact foil portion 25 leading out of the mating half 1 can project from the narrow end face 5, even in regions which are located in the sector of the pivot range of the lever.

Alternatives are possible and within the spirit of the invention. For example, the pivot supports can also advantageously be formed as guide rails along which the lever arm can be pivoted. Therefore, the lever arm is guided over its pivot range. The guide rails serve to support forces and hold the pivoting arm on the desired pivot path.

The guide rail can also be received in a guide groove of the lever arm. The guide groove ensures interlocking action of the lever arm on the guide rail. The forces of the lever are supported by the mating half via the positive interlocking.

A guide portion of the lever arm acting on the guide rail can be arranged along the pivot path at least partially offset to the radial direction of extension of the lever arm. The offset arrangement allows transmission of forces via the guide portion. This allows a larger connection region between the guide rail and the lever arm. In some embodiments, the lever arm can be pivoted to such an extent that in extreme positions the radial direction of extension is located next to the guide rail at the side, while the guide portion still actively transmits the forces to the guide rail.

In a variation of the invention, the lever arm can engage with interlocking fit behind the pivot support in the direction of the pivot axis. The positive locking allows support of forces in the direction of the pivot axis and safeguards the lever against detachment from the mating half in this direction.

The pivot supports can also be arranged in the grip region of the lever arm for a user, viewed in the radial direction. Therefore, the forces introduced by a user directly into the grip region may be transmitted via the shortest route to the mating half. As a result, the pivot bearing or the gearing region is relieved of these forces relatively effectively.

In one particular manner, the lever arm can be pivoted between an open position and a closed position of the two mating halves, and the assembly position is provided outside of the pivot range. Therefore, the lever arm is securely attached to the mating half in the pivot range between open and closed position. Upon leaving the pivot range, it arrives in an assembly position in which it can be detached from the lever.

In a variation of the invention, a catch can be provided between the assembly position and the pivot range between open position and closed position. The catch can only be overcome by a pivoting movement of the lever arm from the assembly position in the direction of the pivot range. This allows pivoting of the lever from the assembly position to the pivot range or actuation range of open position and closed position. It prevents undesirable pivoting of the lever out of the actuation range.

In another particular manner, a latch can be provided between an open position and a closed position of the lever arm, which can only be overcome by pivoting movement of the lever arm from the open position in the direction of the closed position. This ensures securing of the lever arm in the closed position and therefore securing of the two mating halves and their connection lines to one another. The lever may be pivoted with moderate force expenditure from the open position to the closed position. Undesirable return pivoting from the closed position into the open position is, however, prevented. For this purpose, a separate securing, for example, can be released.

The pivot bearing of the lever arm can have a bayonet-type closure via which the lever arm, pivoted into an assembly position, can be detached from the mating half. This allows simple assembly of the lever, which is secured on the mating half after insertion of the bayonet-type closure parts by pivoting.

A support wall, which transmits lateral forces between the mating halves, can advantageously be provided between the first and the second mating half on the housing side that opposes the housing side supporting the lever arm. Correct positioning of the two mating halves, one inside the other, is possible with the aid of the support wall. The support wall supports lateral forces between the mating half which occur during actuation of the lever arm. This favours straight movement of the two mating halves towards one another.

We claim:

1. A plug connector arrangement comprising:

a two-part housing having a first mating half joined to a second mating half via a plug-in control;

the plug-in control having a lever arm pivotally mounted on the first mating half, where the lever arm controls a gearing region forcibly actuating the mating halves; and the lever arm is provided on one side of the first mating half and is mounted to the first mating half by a pivot bearing and a pivot support, the lever arm engages with interlocking fit behind the pivot support in a direction parallel to the pivot axis.

2. The plug connector arrangement of claim 1, wherein the lever arm has a pivot range between an open and a closed position and the pivot support extends over the entire pivot range of the lever arm.

3. The plug connector arrangement of claim 1, wherein the pivot support is formed as a guide rail along which the lever arm can be pivoted.

4. The plug connector arrangement of claim 3, wherein the guide rail is received in a guide groove of the lever arm.

5. The plug connector arrangement of claim 3, wherein the lever arm has a guide portion laterally offset from the lever arm that acts on the guide rail.

6. The plug connector arrangement of claim 1, wherein the pivot support is arranged proximate a grip region for a user of the lever arm.

7. The plug connector arrangement of claim 1, wherein the lever arm can be pivoted into an assembly position in which it can be removed from the first mating half and attached thereto.

8. The plug connector arrangement of claim 7, wherein the lever arm has a pivot range between an open position and a closed position of the two mating halves and the assembly position is provided outside the pivot range.

9. The plug connector arrangement of claim 7, wherein the lever arm has a pivot range between an open position and a closed position, and a catch is provided between the assembly position and the pivot range, the catch can only be overcome by a pivoting movement of the lever arm from the assembly position to the pivot range.

10. The plug connector arrangement of claim 1, wherein a latch is provided between an open position and a closed position of the lever arm, the latch can only be overcome by a pivoting movement of the lever arm from the open position to the closed position.

11. Plug connector arrangement of claim 1, wherein the pivot bearing of the lever arm has a bayonet-type closure via which the lever arm can be detached from the housing part when pivoted into an assembly position.

12. The plug connector arrangement of claim 1, wherein a support wall is provided between the first and the second mating halves on the housing side which opposes the housing side supporting the lever arm, which support wall transmits lateral forces between the mating halves.

13. A plug connector arrangement comprising:

a two-part housing having a first mating half joined to a second mating half via a plug-in control;

the plug-in control having a lever arm pivotally mounted on one side of the first mating half, where the lever arm controls a gearing region forcibly actuating the mating halves;

the lever arm having a pivot range between an open position and a closed position and an assembly position in which the lever arm can be detached from the first mating half outside of the pivot range; and a catch that restricts the lever arm from pivoting from the pivot range to the assembly position, the catch is a spring clip that can be manually displaced to pivot the lever arm from the pivot range to the assembly position, and the catch is integrally formed with the first mating half.

14. A plug connector arrangement comprising:

a two-part housing having a first mating half joined to a second mating half via a plug-in control;

the plug-in control having a lever arm pivotally mounted on one side of the first mating half, where the lever arm controls a gearing region forcibly actuating the mating halves;

the lever arm having a pivot range between an open position and a closed position and an assembly position in which the lever arm can be detached from the first mating half outside of the pivot range;

a catch that restricts the lever arm from pivoting from the pivot range to the assembly position; and a latch provided between the open position and the closed position that can only be overcome by a pivoting movement of the lever arm from the open position to the closed position.

15. A plug connector arrangement comprising:

a two-part housing having a first mating half joined to a second mating half via a plug-in control;

the plug-in control having a lever arm pivotally mounted on one side of the first mating half by a pivot bearing and a pivot support where the lever arm controls a gearing region forcibly actuating the mating halves;

the lever arm having a pivot range between an open position and a closed position and an assembly position in which the lever arm can be detached from the first mating half outside of the pivot range; and a catch that restricts the lever arm from pivoting from the pivot range to the assembly position.

16. The plug connector arrangement of claim 15, wherein the pivot support extends over the entire pivot range of the lever arm.

17. The plug connector arrangement of claim 15, wherein the pivot bearing of the lever arm has a bayonet-type closure via which the lever arm, pivoted into an assembly position, can be detached from the first mating half.

* * * * *